US005953787A

United States Patent [19]

Lee

[11] Patent Number: 5,953,787

[45] Date of Patent: Sep. 21, 1999

[54] SUCTION GLOBE OF A VACUUM CLEANER

[75] Inventor: Jin-Gon Lee, Kwangju, Rep. of Korea

[73] Assignee: Kwangiu Electronics Co., Ltd., Kwangju, Rep. of Korea

[21] Appl. No.: 08/926,367

[22] Filed: Sep. 9, 1997

[30] Foreign Application Priority Data

Sep. 10, 1996 [KR] Rep. of Korea ..... 96-28749

[51] Int. Cl.[6] ..... A47L 9/00

[52] U.S. Cl. ..... 15/326; 15/415.1; 181/229; 181/256

[58] Field of Search ..... 15/326, 415.1; 181/256, 229, 230, 294, 224

[56] References Cited

U.S. PATENT DOCUMENTS 3,894,610 7/1975 Halter ..... 181/256

5,471,707 12/1995 Kang ..... 15/326

FOREIGN PATENT DOCUMENTS 34563 3/1977 Japan ..... 15/326

*Primary Examiner*—Gary K. Graham

*Attorney, Agent, or Firm*—Perman & Green, LLP

[57] ABSTRACT

A suction globe of a vacuum cleaner which can reduce noise due to friction and vortex motion generated from a suction passage of a suction globe of a vacuum cleaner. The suction globe of a vacuum cleaner, comprises a soft brush body formed to move forward or backward through a front roller and a rear roller; a brush cover formed over the soft brush body; and a connection holder having a connection passage extended from a body passage formed in the soft brush body through the brush cover, on which body passage hairs with a predetermined length are planted.

1 Claim, 1 Drawing Sheet

SUCTION GLOBE OF A VACUUM CLEANER

BACKGROUND OF THE INVENTION

A. Field of the Invention

The present invention relates to a suction globe of a vacuum cleaner. More particularly, the present invention relates to a suction globe of a vacuum cleaner which can reduce noise due to friction and vortex motion generated from a suction passage of a suction globe of a vacuum cleaner.

B. Description of the Related Art

Generally, various types of vacuum cleaners, which perform cleaning by sucking dust and alien substances by a suction force of a driving motor mounted in a main body of vacuum cleaners, have been proposed.

As shown in FIG. 1, a suction globe 10, which sucks the dust and the alien substances, is combined with a suction pipe 20.

In addition, the suction globe 10 includes:

a soft brush body 13 moved forward or rearward by a front roller 11 and a rear roller 12;

a brush cover 14 formed over the soft brush body 13; and a connection holder 15 having a connection passage 151 connected to a passage 131 formed in the soft brush body 13 by the brush cover 14.

When power is applied to the vacuum cleaner and vacuum pressure is generated by the driving motor, the dust or the alien substances are sucked through the passage 131 and the connection passage 151, and collected to a paper bag.

Lots of areas can be easily cleaned by moving the soft brush body 13 forward or rearward, using the front roller 11 and the rear roller 12.

However, the conventional vacuum cleaner has a disadvantage in that big noise is caused by friction of air and vortex motion during the cleaning since the soft brush body 13 having the passage 131 and the connection holder 15 having the connection passage 151 are made of only plastic.

SUMMARY OF THE INVENTION

Accordingly, the object of the present invention is to provide a suction globe of a vacuum cleaner which can reduce noise due to friction and vortex motion generated from a suction passage of a suction globe of a vacuum cleaner by planting hairs along a passage of a soft brush body forming a suction globe to substantially obviate one or more of the problems due to limitations and disadvantages of the related art.

To achieve the object and in accordance with the purpose of the invention, as embodied and broadly described herein, a suction globe of a vacuum cleaner, comprises:

a soft brush body formed to move forward or backward through a front roller and a rear roller;

a brush cover formed over the soft brush body; and;

a connection holder having a connection passage extended from a passage formed in the soft brush body through the brush cover, hairs with predetermined length are planted.

Additional objects and advantages of the invention are set forth in part in the description which follows, and in part will be obvious from the description, or may be learned by practice of the invention. The objects and advantages of the invention will be realized and attained by means of the elements and combinations particularly pointed out in the appended claims.

BRIEF DESCRIPTION OF THE DRAWINGS

The accompanying drawings, illustrate an embodiment of the invention and, together with the description, serve to explain the principles of the invention.

In the drawings.

DESCRIPTION OF THE PREFERRED EMBODIMENT

Figure 1:
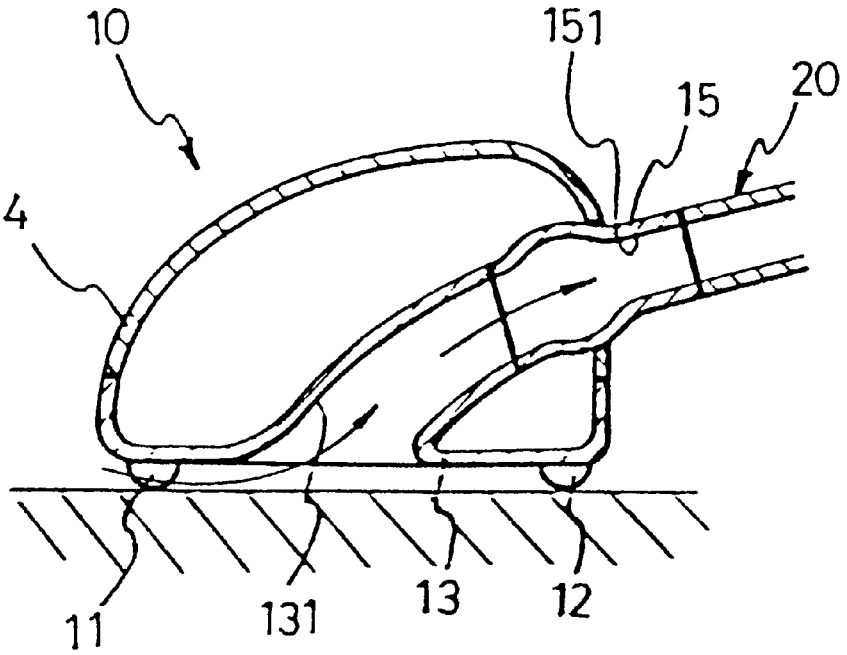
FIG. 1 is a schematic section view of a suction globe of a conventional vacuum cleaner.

Reference will now be made in detail to a preferred embodiment of the present invention, an example of which is illustrated in the accompanying drawings. Same reference numerals are indicated to same portions as portions in FIG. 1, and explanation thereof is omitted.

Figure 2:
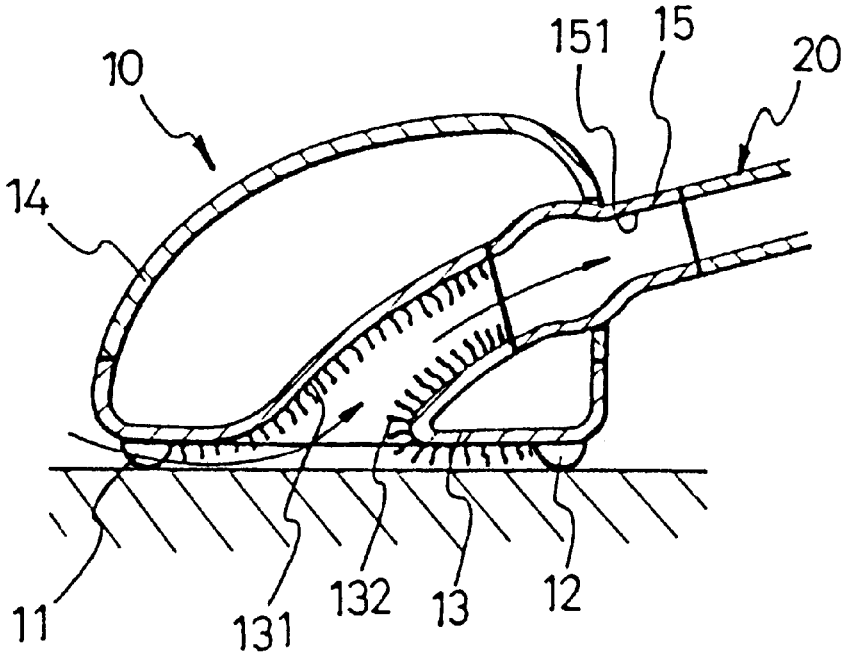
FIG. 2 is a schematic section view of a suction globe of a vacuum cleaner according to the present invention.

Referring to FIG. 2, a suction globe of a vacuum cleaner, comprises:

a soft brush body 13 formed to move forward or backward through a front roller 11 and a rear roller 12;

a brush cover 14 formed over the soft brush body 13; and a connection holder 15 having a connection passage 151 extended from a body passage 131 formed in the soft brush body 13 through the brush cover 14, hairs 132 with predetermined length are planted.

Here, the hairs are planted by well-known technique.

The operation and the effect of the suction globe of a vacuum cleaner according to the present invention are explained as follows.

When power is applied to the vacuum cleaner according to the preferred embodiment of the present invention, dust or alien substances are sucked to the suction globe 10 through the body passage 131 and the connection passage 151, and collected to a paper bag. The hairs 132, which are planted in the soft brush body 13 of the suction globe 10, absorb the noise, thereby reducing the noise caused by air friction and the vortex motion when the dust or the alien substances are exhausted through a motor.

As described above, the effect of the suction globe of a vacuum cleaner according to the preferred embodiment of the present invention lies in that the noise due to the friction and the vortex motion generated in the suction passage of the suction globe can be reduced by planting the hairs 132 along the passage 131 of the soft brush body 13 forming the suction globe 10.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. A suction globe of a vacuum cleaner having a front roller and a rear roller, comprising:

a soft brush body formed to move forward or backward through the intermediary of the front roller and the rear roller;

a brush cover formed over the soft brush body; and;

a connection holder having a connection passage extended from a body passage formed in the soft brush body through the brush cover, said body passage having hairs with a predetermined length planted therein.

* * * * *